US006726031B2

(12) United States Patent
Laupan

(10) Patent No.: US 6,726,031 B2
(45) Date of Patent: Apr. 27, 2004

(54) DISHWASHER RACK CONSTRUCTION

(75) Inventor: William R. Laupan, Madison, WI (US)

(73) Assignee: Traex Company, Toledo, OH (US)

( * ) Notice: Subject to any disclaimer, the term of this patent is extended or adjusted under 35 U.S.C. 154(b) by 16 days.

(21) Appl. No.: 10/068,477

(22) Filed: Feb. 7, 2002

(65) Prior Publication Data

US 2002/0117461 A1 Aug. 29, 2002

Related U.S. Application Data

(60) Provisional application No. 60/267,637, filed on Feb. 9, 2001.

(51) Int. Cl.[7] ..... A47F 7/00

(52) U.S. Cl. ..... 211/41.8; 211/74; 211/126.12; 206/509

(58) Field of Search ..... 211/41.8, 126.2, 211/126.12, 74; 206/509, 512, 561; 220/4.03

(56) References Cited

U.S. PATENT DOCUMENTS 3,252,582 A * 5/1966 Kesilman et al.
3,283,915 A * 11/1966 Maslow
3,306,463 A * 2/1967 Maslow
3,584,744 A * 6/1971 Ettlinger
D259,818 S * 7/1981 Beavis
4,527,707 A * 7/1985 Heymann et al.
5,934,486 A * 8/1999 Jarvis et al. ..... 211/41.8
6,634,510 B2 * 10/2003 Larson et al. ..... 211/41.8

OTHER PUBLICATIONS

Admitted prior art, 2 pages.

* cited by examiner

*Primary Examiner*—Robert W. Gibson, Jr.
(74) *Attorney, Agent, or Firm*—Emch, Schaffer, Schaub & Porcello Co., LPA

(57) ABSTRACT

Dishwasher rack and extender for an automatic dishwasher has 12, 20, 30 or 42 compartments defined by a plurality of rows of adjacent hexagonal compartments with a half hexagonal compartment at the end of each row and two rows of pentagonal compartments with a half pentagonal compartment at one end. The rows of pentagonal compartments border opposite sides of the rows of hexagonal compartments and the end compartments alternate ends from row to row.

33 Claims, 5 Drawing Sheets

DISHWASHER RACK CONSTRUCTION

CROSS-REFERENCE TO RELATED APPLICATION

This application claims benefit of U.S. Provisional Application No. 60/267,637, filed on Feb. 9, 2001.

STATEMENT CONCERNING FEDERALLY SPONSORED RESEARCH OR DEVELOPMENT

Not applicable.

FIELD OF THE INVENTION

This invention relates to racks for cups and glasses that are used in commercial automatic dishwashers.

BACKGROUND OF THE INVENTION

It is common in the restaurant and food service industry to use automatic dishwashers for cups and glasses which accept a standard dishwasher rack that is approximately 20"×20" square (actually 19.72"×19.72"). Different racks are used with different size compartments to most closely match the diameter of the glasses or cups being washed. Common sizes in the industry are 9 compartment, 16 compartment, 25 compartment, 36 compartment and 49 compartment racks. For tall glasses, extenders having the same number of compartments are stacked on top of the rack, as is well known in the industry.

If a glass is too small for the compartment in which it is placed, damage to the glass can result. This damage is expensive not only in the lost glass, but also in the cost of cleanup and the potential that the broken glass may injure personnel or damage the dishwashing equipment or plumbing.

There are a considerable number of glasses which are too large to fit into the compartments of a smaller compartment rack, but too small to properly fit in the compartments of a larger compartment rack. The solution to date has been to place these glasses in a larger compartment rack and live with the damage. There are not, to the knowledge of applicant, in-between size compartment racks available which would more closely fit these types of glasses.

SUMMARY OF THE INVENTION

The invention provides an improved dishwashing rack and extender with a unique configuration of compartments. Specific embodiments of the rack and extender have 12, 20, 30 or 42 compartments all with a standard sized frame. In particular the invention provides an automatic dishwasher rack and extender for holding glasses or cups in an automatic dishwasher of the type having side walls in a rectangular shape, which is square if the side walls are of approximately equal length.

Specifically, the rack includes an open supporting grid spanning the side walls in a lower portion of the rack and an array of compartments above the supporting grid in an upper portion of the rack. The rack has a plurality of adjacent rows of hexagonal compartments, each row including a half hexagonal compartment at one end, with two rows of pentagonal compartments along opposite sides of the rows of hexagonal compartments. Each row of pentagonal compartments includes a half pentagonal compartment at one end.

Similarly, the extender has a plurality of adjacent rows of hexagonal compartments, each row including a half hexagonal compartment at one end, with two rows of pentagonal compartments along opposite sides of the rows of hexagonal compartments. Each row of pentagonal compartments includes a half pentagonal compartment at one end.

In one preferred form, the invention provides a dishwashing rack which spreads 20 compartments over the area of the rack in a relatively uniform and symmetrical pattern, as is required for proper loading of the dishwasher. In order to do so, the invention provides three rows of nested hexagonal compartments, with a half compartment on one end of each row. Bordering the top row and bordering the bottom row of these three hexagonal and half hexagonal compartment rows is a row of pentagonal compartments, which has at one end a half pentagonal compartment. Thus, the rack has five rows, the middle three of which are hexagonal or half hexagonal and the top and bottom rows of which are pentagonal or half pentagonal. The half compartments, whether pentagonal or hexagonal, alternate from end to end from one row to the next. With this configuration, there are five rows, with four glasses fitting into each full compartment in each of the rows for a total of 4 glasses per row which equals 20 glasses per rack. In the preferred embodiments, the number of glasses per rack is varied by varying the number of rows and compartments per row, but retaining the configuration of hexagonal end rows, pentagonal middle rows and half compartments at alternating ends of the rows, to also yield 12, 30 and 42 compartment racks.

Other objects and advantages of the invention will be apparent from the detailed description and drawings.

DETAILED DESCRIPTION OF THE PREFERRED EMBODIMENT

Figure 1:
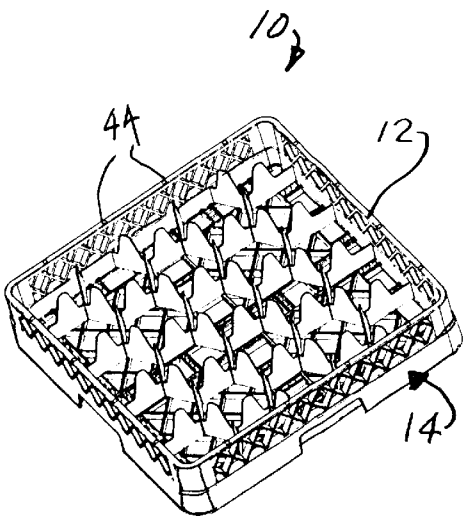
FIG. 1 is a perspective view of a dishwasher rack incorporating the invention.

Referring to FIG. 1, a dishwasher rack 10 of the invention is of typical construction except for the configuration of dividers which define the compartments into which glasses or cups to be washed are placed. Thus, the rack 10 has typical side walls 12, which are arranged in a square rectangular shape in standard dimensions (19.72"×19.72" for example) and are open at the top. The lower portion of the rack 10 is defined by a standard open grid 14 as is conventional, and the grid 14 is what supports the glasses when they are in the compartments.

Figure 2:
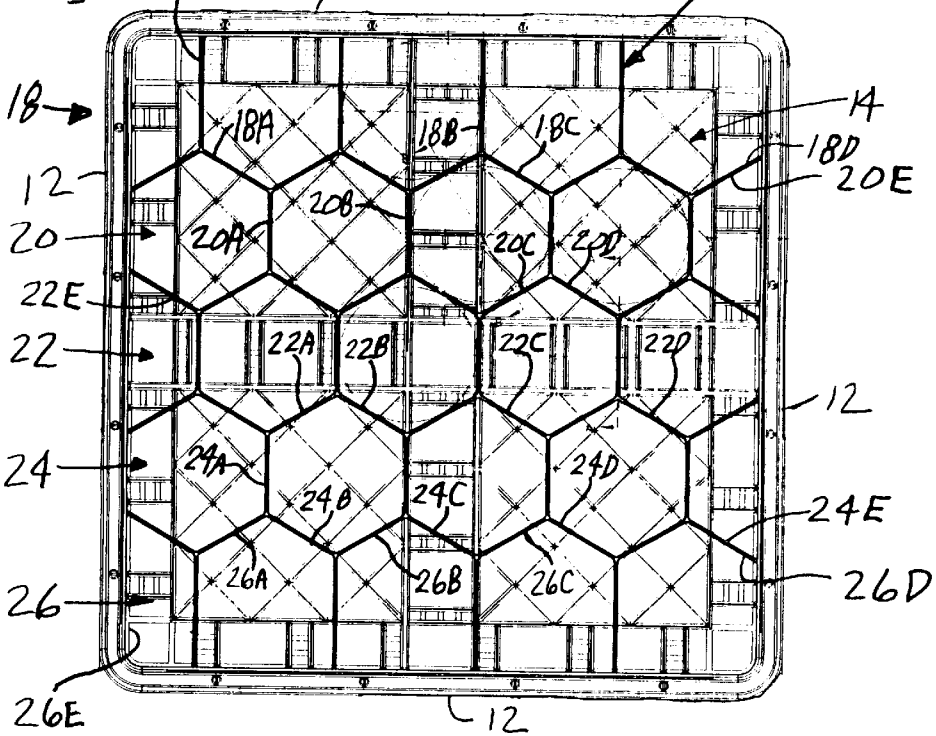
FIG. 2 is a top plan view of the dishwasher rack of FIG. 1.

Referring particularly to FIG. 2, a compartment grid 16 of the invention, which is molded integral with the side walls, includes five rows 18, 20, 22, 24 and 26 as illustrated. The middle three rows 20, 22 and 24 are each made up of four hexagonal compartments 20A–D, 22A–D and 24A–D. Each row 20, 22 and 24 also includes a half hexagonal compartment 20E, 22E and 24E respectively, with the half hexagonal compartments alternating in the end they are on from one row to the adjacent row. Thus, the top and bottom half hexagonal compartments 20E and 24E are on the right side as shown in FIG. 2, and the half hexagonal compartment 22E which is in the row between the rows 20 and 24 is at the left side of the rack as shown in FIG. 2. The compartments of the adjacent rows are nested with one another, so that adjacent compartments share a wall.

Row 18 is above the three hexagonal rows 20, 22 and 24 and row 26 is below them. Each of the rows 18 and 26 include four pentagonal compartments which are nested with the adjacent hexagonal compartments of the respective rows 20 and 24 so that adjacent compartments share a wall. Each of the rows 18 and 26 also have a half pentagonal compartment at its left end, compartment 18E in row 18 and compartment 26E in row 26. Thus, the half compartments, whether half hexagonal or half pentagonal, alternate from end to end from one adjacent row to the next. In other words, half pentagonal compartment 18E is on the left, half hexagonal compartment 20E is on the right, half hexagonal compartment 22E is on the left, half hexagonal compartment 24E is on the right and half pentagonal compartment 26E is on the left.

This configuration results in 20 full size compartments, each of which is able to hold a glass or cup which is 3.93" in diameter or less. Smaller cups or glasses could also be placed in the half compartments 18E, 20E, 22E, 24E and 26E, if practical. It is noted that the walls of the compartments are paddle shaped to extend higher in the center thereof than at the ends so as to protect glasses placed in the compartments and yet permit water flow through a substantial portion of the dividers.

Figure 3:
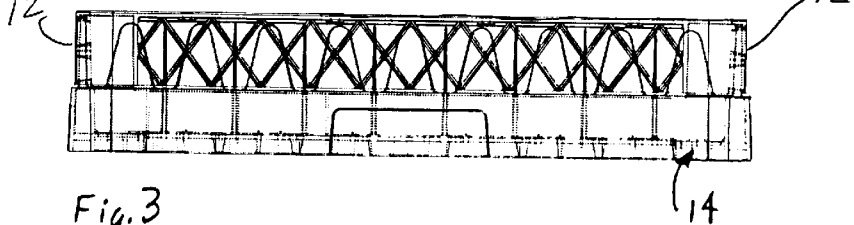
FIG. 3 is a front side plan view of the dishwasher rack of FIG. 2.
Figure 4:
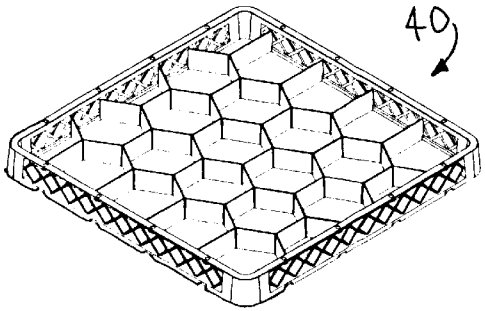
FIG. 4 is a perspective view of an extender for the dishwasher rack of FIG. 1.
Figure 5:
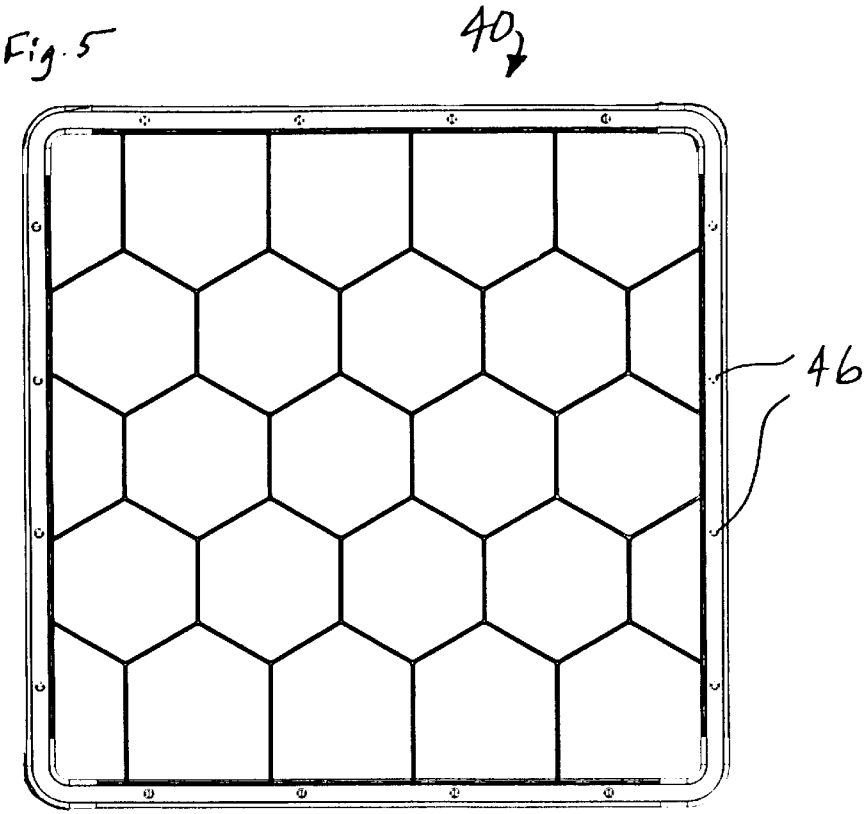
FIG. 5 is a top plan view of the extender of FIG. 4.
Figure 6:
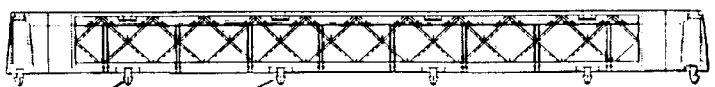
FIG. 6 is a front side plan view of the extender of FIG. 5.

For taller cups and glasses, as is conventional, one or more extenders are provided. As shown in FIGS. 4–6, an extender of the invention has the same pattern of compartments as the rack shown in FIGS. 1–3. As is conventional, the extender 40 has pins 42 extending downwardly from its side walls which fit into corresponding holes 44 in the tops of the side walls 12 of the rack 10. Each extender also has holes 46 in the tops of its side walls to receive the pins 42 of additional extenders if necessary.

A dish rack and extender of the invention may be made of plastic and be injection molded. For example, a polypropylene copolymer is a common material for such racks and extenders.

Figure 7A:
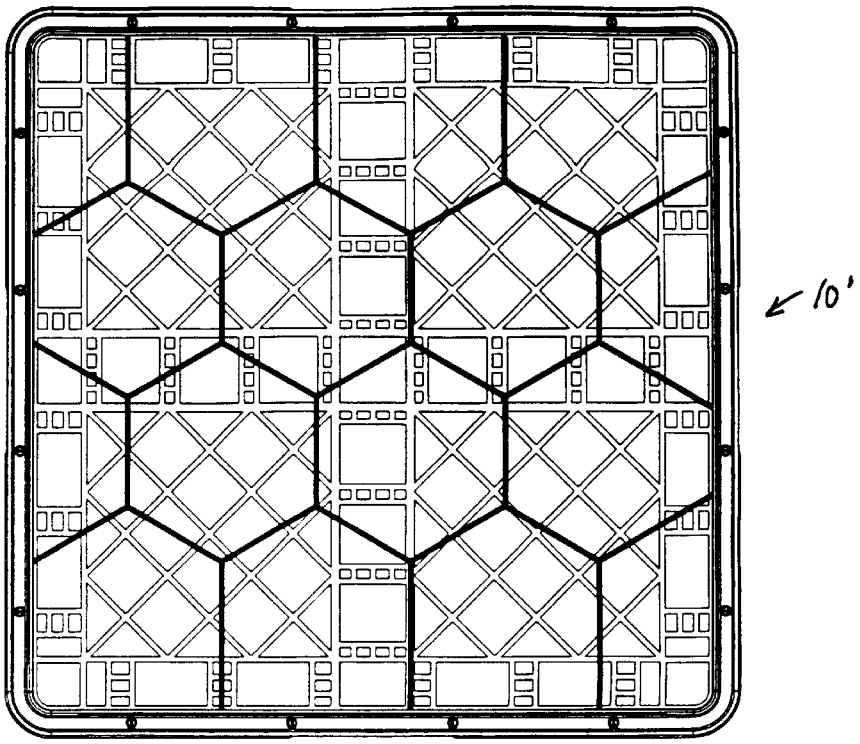
FIGS. 7A and 7B are top plan views of an alternate dishwasher rack and an alternate extender, respectively, with a 12 pocket compartment grid.
Figure 7B:
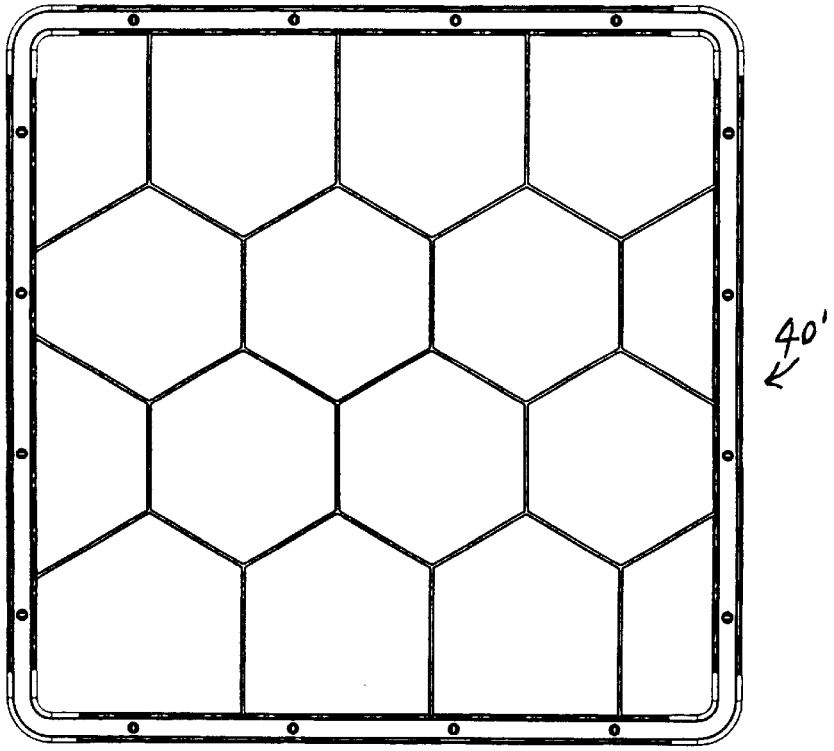
Figure 8A:
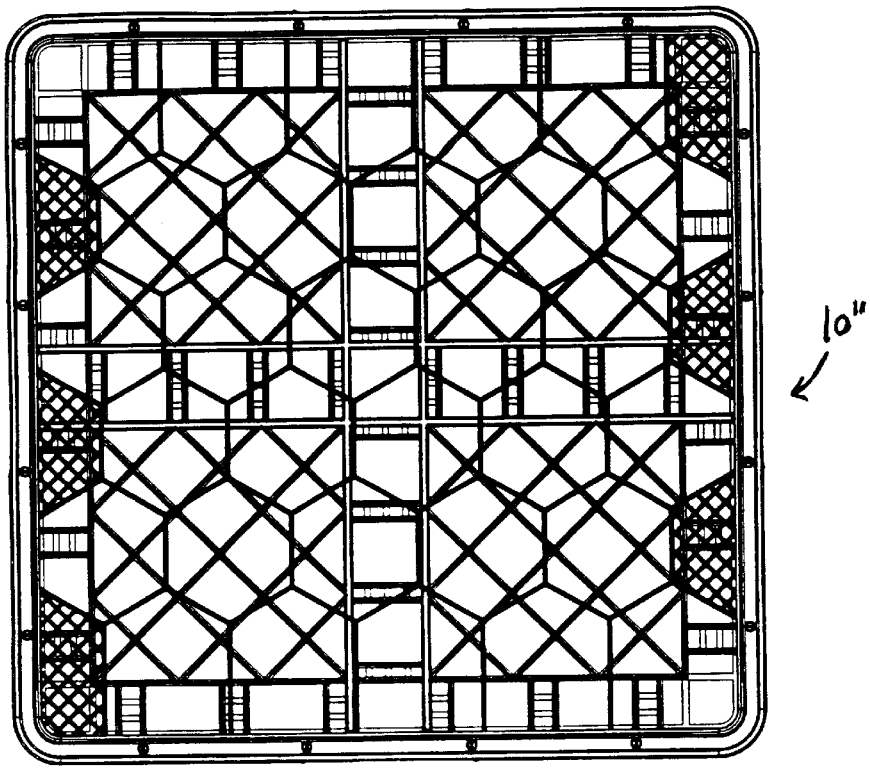
FIGS. 8A and 8B are top plan views of an alternate dishwasher rack and an alternate extender, respectively, with a 30 pocket compartment grid.
Figure 8B:
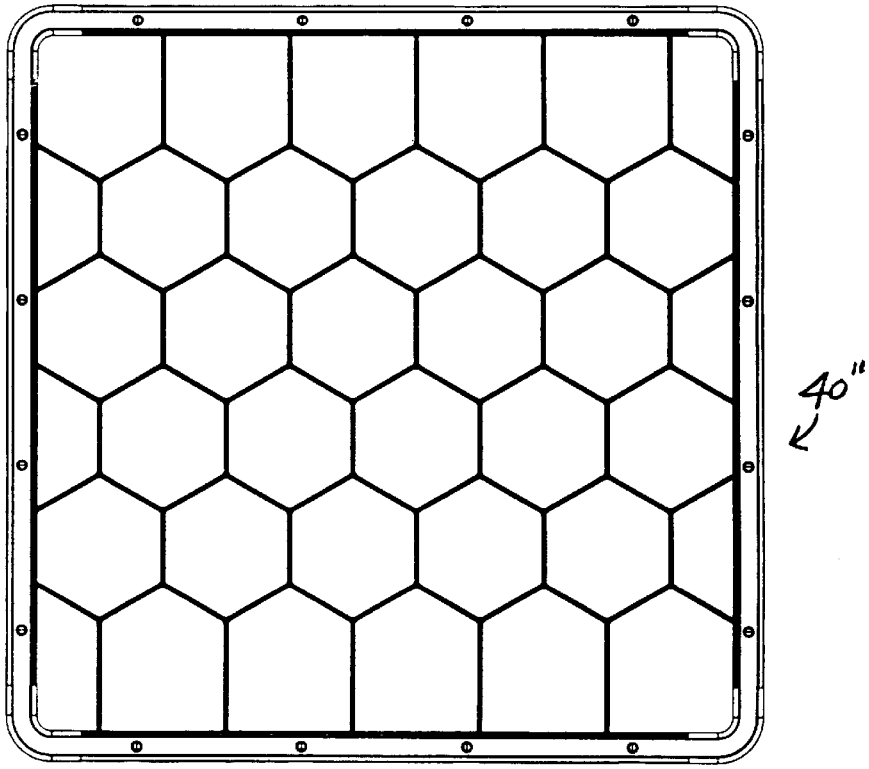
Figure 9A:
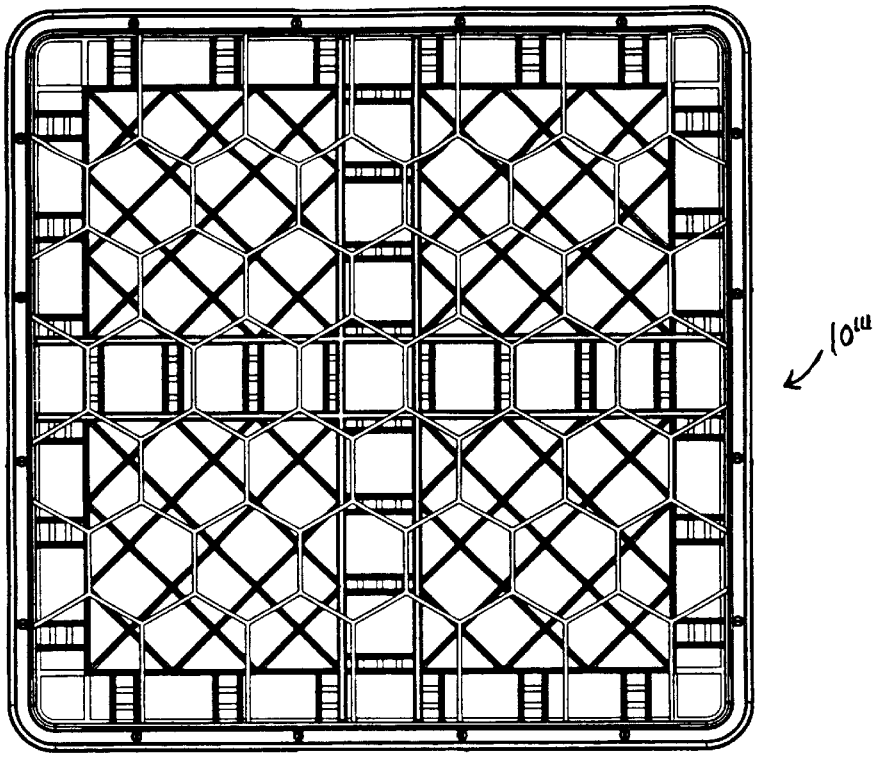
FIGS. 9A and 9B are top plan views of an alternate dishwasher rack and an alternate extender with a 42 pocket compartment grid.
Figure 9B:
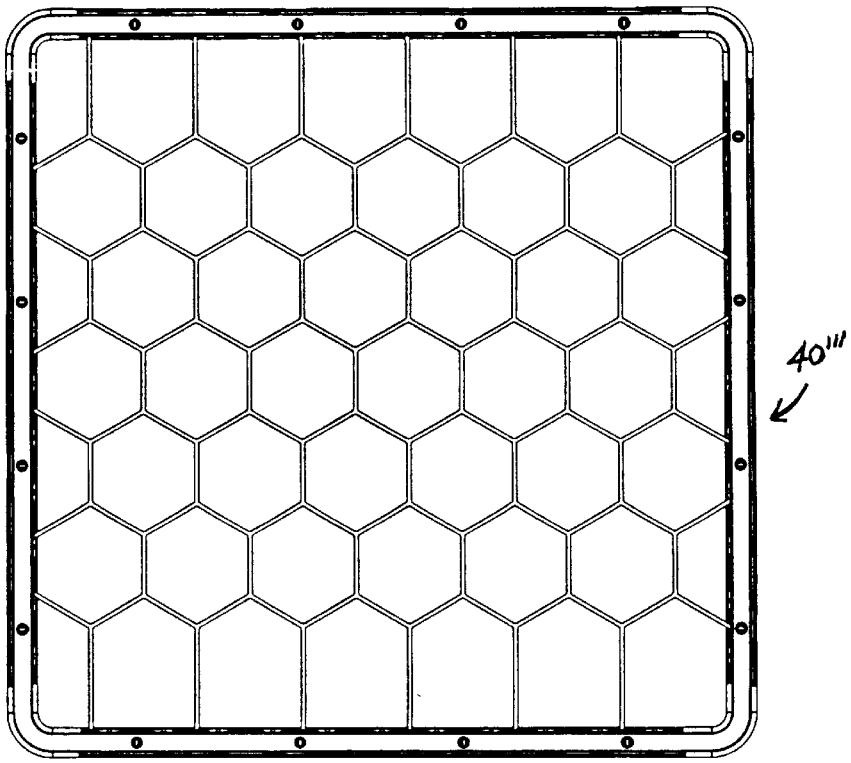

FIGS. 7–9 show racks and extenders having different compartment patterns but the same overall outside dimension as the above described rack 10 and extender 40. In particular, FIGS. 7A and 7B show a rack 10' and an extender 40', respectively, with a 12 pocket compartment pattern. FIGS. 8A and 8B show a rack 10" and an extender 40", respectively, with a 30 pocket compartment pattern. FIGS. 9A and 9B show a rack 10'" and an extender 40'", respectively, with a 42 pocket compartment pattern.

The rack 10' of FIG. 7A includes four rows with the middle two rows each being made up of three hexagonal compartments. Each middle row also includes a half hexagonal compartment. The half hexagonal compartments alternate in the end they are on from one row to the adjacent row. The compartments of the adjacent rows are nested with one another, so that adjacent compartments share a wall. The other two rows include three pentagonal compartments which are nested with the adjacent hexagonal compartments. Each of these rows also has a half pentagonal compartment at one end. This configuration results in 16 full size compartments and four half compartments of a greater dimension than the compartments of the first described embodiment. The extender 40' of FIG. 7B has the same compartment configuration.

The rack 10" of FIG. 8A includes six rows with the middle four rows each being made up of five hexagonal compartments. Each middle row also includes a half hexagonal compartment. The half hexagonal compartments alternate in the end they are on from one row to the adjacent row. The compartments of the adjacent rows are nested with one another, so that adjacent compartments share a wall. The other two rows include five pentagonal compartments which are nested with the adjacent hexagonal compartments. Each of these rows also has a half pentagonal compartment at one end. This configuration results in 30 full size compartments and six half compartments of a lesser dimension than the first described embodiment. The extender 40" of FIG. 8B has the same compartment configuration.

The rack 10'" of FIG. 9A includes seven rows with the middle five rows each being made up of six hexagonal compartments. Each middle row also includes a half hexagonal compartment. The half hexagonal compartments alternate in the end they are on from one row to the adjacent row. The compartments of the adjacent rows are nested with one another, so that adjacent compartments share a wall. The other two rows include six pentagonal compartments which are nested with the adjacent hexagonal compartments. Each of these rows also has a half pentagonal compartment at one end. This configuration results in 42 full size compartments and seven half compartments of a lesser dimension than the previous embodiment. The extender 40'" of FIG. 9B has the same compartment configuration.

Preferred embodiments of the invention have been disclosed and described. Many modifications and variations to the preferred embodiments described will be apparent to those skilled in the art. Therefore, the invention should not be limited to the embodiments described, but should be defined by the claims which follow.

I claim:

1. A dishwasher rack comprising two longitudinal side walls and two latitudinal side walls defining an outer rectangular shape, an open supporting grid spanning said side walls in a lower portion of said rack;

a plurality of adjacent rows of hexagonal compartment extending completely between said longitudinal side walls, each said row including a half hexagonal compartment at one end of each said row positioned immediately adjacent to one of said longitudinal side walls and a full compartment positioned immediately adjacent to the other said longitudinal side wall;

a first row of pentagonal compartments extending completely between said longitudinal side walls along one side of said rows of hexagonal compartments adjacent to one of said latitudinal side walls; and a second row of pentagonal compartments extending completely between said longitudinal side walls along the opposite side of said rows of hexagonal compartments adjacent to the other said latitudinal side wall;

said first and second rows of pentagonal compartments each include a half pentagonal compartment at one end of each said row positioned immediately adjacent to one of said longitudinal side walls and a full compartment positioned immediately adjacent to the other said longitudinal side wall.

2. The rack of claim 1, wherein the half hexagonal and half pentagonal compartments alternate end to end in position from one row to the next adjacent row.

3. The rack of claim 1, further comprising an extender which can be affixed to the top of the rack.

4. The rack of claim 1, wherein there are two adjacent rows of hexagonal compartments, each said row including three hexagonal compartments.

5. The rack of claim 4, wherein each of said first and second rows of pentagonal compartments include three pentagonal compartments.

6. The rack of claim 1, wherein there are three adjacent rows of hexagonal compartments, each said row including four hexagonal compartments.

7. The rack of claim 6, wherein each of said first and second rows of pentagonal compartments include four pentagonal compartments.

8. The rack of claim 1, wherein there are four adjacent rows of hexagonal compartments, each said row including five hexagonal compartments.

9. The rack of claim 8, wherein each of said first and second rows of pentagonal compartments include five pentagonal compartments.

10. The rack of claim 1, wherein there are five adjacent rows of hexagonal compartments, each said row including six hexagonal compartments.

11. The rack of claim 10, wherein each of said first and second rows of pentagonal compartments include six pentagonal compartments.

12. A dishwasher rack extender comprising two longitudinal side walls and two latitudinal side walls defining an outer rectangular shape;

a plurality of adjacent rows of hexagonal compartments extending completely between said longitudinal side walls, each said row including a half hexagonal compartment at one end of each row positioned immediately adjacent to one of said longitudinal side walls and a full compartment positioned immediately adjacent to the other said longitudinal side wall;

a first row of pentagonal compartments extending completely between said longitudinal side walls along one side of said rows of hexagonal compartments adjacent to one of said latitudinal side walls; and a second row of pentagonal compartments extending completely between said longitudinal side walls along the opposite side of said rows of hexagonal compartments adjacent to one of said latitudinal side walls;

said first and second rows of pentagonal compartments each including a half pentagonal compartment at one end of each said row positioned immediately adjacent to one of said longitudinal side walls and a full compartment positioned immediately adjacent to the other said longitudinal side wall.

13. The extender of claim 12, wherein the half hexagonal and half pentagonal compartments alternate end to end in position from one row to the next adjacent row.

14. The extender of claim 12, further comprising a rack which can be affixed to the bottom of the extender.

15. The extender of claim 12, wherein there are two adjacent rows of hexagonal compartments, each said row including three hexagonal compartments.

16. The extender of claim 15, wherein each of said first and second rows of pentagonal compartments include three pentagonal compartments.

17. The extender of claim 12, wherein there are three adjacent rows of hexagonal compartments, each said row including four hexagonal compartments.

18. The extender of claim 17, wherein each of said first and second rows of pentagonal compartment include four pentagonal compartments.

19. The extender of claim 12, wherein there are four adjacent rows of hexagonal compartments, each said row including five hexagonal compartments.

20. The extender of claim 19, wherein each of said first and second rows of pentagonal compartments include five pentagonal compartments.

21. The extender of claim 12, wherein there are five adjacent rows of hexagonal compartments, each said row including six hexagonal compartments.

22. The extender of claim 21, wherein each of said first and second rows of pentagonal compartments include six pentagonal compartments.

23. A dishwasher rack comprising two longitudinal side walls and two latitudinal side walls defining an outer rectangular shape, an open supporting grid spanning said side walls in a lower portion of said rack;

a plurality of adjacent rows of first compartments extending completely between said longitudinal side walls, each said row including a half compartment at one end of each said row positioned immediately adjacent to one of said longitudinal side walls and a full compartment positioned immediately adjacent to the other said longitudinal side wall;

a row of second compartments extending completely between said longitudinal side walls along one side of said rows of first compartments adjacent to one of said latitudinal side walls, said row of second compartments including a half compartment at one end of said row positioned immediately adjacent to one of said longitudinal side walls and a full compartment positioned immediately adjacent to the other said longitudinal side wall; and a row of third compartments extending completely between said longitudinal side walls along the opposite side of said rows of first compartments adjacent to the other said latitudinal side wall, said row of a third compartments including a half compartment at one end of said row position immediately adjacent to one of said longitudinal side walls and a full compartment positioned immediately adjacent to the other said longitudinal side wall;

said half compartments alternate end to end in position from one row to the next adjacent row.

24. A dishwasher rack comprising two longitudinal side walls and two latitudinal side walls defining an outer rectangular shape, an open supporting grid spanning said side walls in a lower portion of said rack;

a plurality of adjacent rows of first compartments having a first configuration extending completely between said longitudinal side walls, each said row including a half compartment defining substantially half said first configuration at one end of each said row positioned immediately adjacent to one of said longitudinal side walls and a full compartment positioned immediately adjacent to the other said longitudinal side wall; and a pair of rows of second compartments having a second configuration different from said first configuration extending completely between said longitudinal side walls adjacent to said latitudinal side walls along opposite sides of said rows of first compartments, said pair of rows each including a half compartment defining substantially half said second configuration at one end of each of said pair of rows positioned immediately adjacent to one of said longitudinal side walls and a full compartment positioned immediately adjacent to the other said longitudinal side wall;

said half compartments alternate end to end in position from one row to the next adjacent row.

25. The rack of claim 24, wherein said first configuration is hexagonal and said second configuration is pentagonal.

26. The rack of claim 24, wherein there are two adjacent rows of said first compartment, each said row including three first compartments of said first configuration.

27. The rack of claim 26, wherein said each of said pair of rows includes three second compartments of said second configuration.

28. The rack of claim 24, wherein there are three adjacent rows of said first compartments, each said row including four first compartments of said first configuration.

29. The rack of claim 28, wherein each of said pair of rows includes four second compartments of said second configuration.

30. The rack of claim 24, wherein there are four adjacent rows of said first compartments, each said row including five first compartments of said first configuration.

31. The rack of claim 30, wherein each of said pair of rows includes five second compartments of said second configuration.

32. The rack of claim 24, wherein there are five adjacent rows of said first compartments, each said row including six first compartments of said first configuration.

33. The rack of claim 32, wherein each of said pair of rows includes six second compartments of said second configuration.

* * * * *

UNITED STATES PATENT AND TRADEMARK OFFICE

CERTIFICATE OF CORRECTION

PATENT NO. : 6,726,031 B2
DATED : April 27, 2004
INVENTOR(S) : William R. Laupan It is certified that error appears in the above-identified patent and that said Letters Patent is hereby corrected as shown below:

Column 4,
Line 48, the word “compartment” should be -- compartments --.

Column 6,
Line 39, after the word “of”, delete “a”.

Signed and Sealed this

Thirteenth Day of July, 2004

JON W. DUDAS
*Acting Director of the United States Patent and Trademark Office*